US011021821B2

(12) United States Patent
Hansen et al.

(10) Patent No.: US 11,021,821 B2
(45) Date of Patent: Jun. 1, 2021

(54) METHOD FOR MAKING A SPUNBONDED HIGH LOFT NONWOVEN WEB

(71) Applicants: Fibertex Personal Care A/S, Aalborg (DK); Reifenhauser GmbH & Co. KG Maschinenfabrik, Troisdorf (DE)

(72) Inventors: Morten Rise Hansen, Aalborg (DK); Thomas Broch, Gistrup (DK); Sebastian Sommer, Troisdorf (DE)

(73) Assignees: FIBERTEX PERSONAL CARE A/S, Aalborg (DK); REIFENHAUSER GMBH & CO. KG MASCHINENFABRIK, Troisdorf (DE)

( * ) Notice: Subject to any disclaimer, the term of this patent is extended or adjusted under 35 U.S.C. 154(b) by 132 days.

(21) Appl. No.: 16/455,785

(22) Filed: Jun. 28, 2019

(65) Prior Publication Data

US 2019/0316284 A1 Oct. 17, 2019

Related U.S. Application Data

(62) Division of application No. 15/597,171, filed on May 17, 2017, now Pat. No. 10,435,829.

(30) Foreign Application Priority Data

May 18, 2016 (EP) ..... 16170169

(51) Int. Cl.
*D04H 3/14* (2012.01)
*D01D 5/098* (2006.01)
(Continued)

(52) U.S. Cl.
CPC ..... *D04H 3/14* (2013.01); *D01D 5/0985* (2013.01); *D04H 1/50* (2013.01); *D04H 3/147* (2013.01);
(Continued)

(58) Field of Classification Search
CPC ..... D04H 3/14; D04H 3/007; D04H 3/147; D04H 3/08; D04H 3/16; D04H 1/50; D01D 5/0985
See application file for complete search history.

(56) References Cited

U.S. PATENT DOCUMENTS 5,547,746 A 8/1996 Burton, Sr.
5,707,468 A 1/1998 Arnold et al.
(Continued)

FOREIGN PATENT DOCUMENTS

EP 0765959 A1 4/1997
JP H0959860 A 3/1997
(Continued)

OTHER PUBLICATIONS

An English translation obtained from the European Patent Office for JP 2013-133579 to Zeisho et al. (Year: 2013).*
(Continued)

*Primary Examiner* — Jeremy R Pierce
(74) *Attorney, Agent, or Firm* — Kilyk & Bowersox, P.L.L.C.

(57) ABSTRACT

The invention relates to a method for making a spunbonded high loft nonwoven web comprising crimped multicomponent fibers, the process comprising continuously spinning the fibers, directing the fibers to a spin-belt by deflectors and/or air streams, laying down the fibers on the spinbelt and pre-consolidating the fibers after laydown using one or more pre-consolidation rollers to form a pre-consolidated web, wherein a first component of the fibers comprises a PP homopolymer and a second component of the fibers comprises a PP/PE copolymer, wherein the pre-consolidation rollers are operated at a temperature of smaller 110° C. and/or a linear contact force of smaller 5 N/mm.

18 Claims, 4 Drawing Sheets

Figure 1:
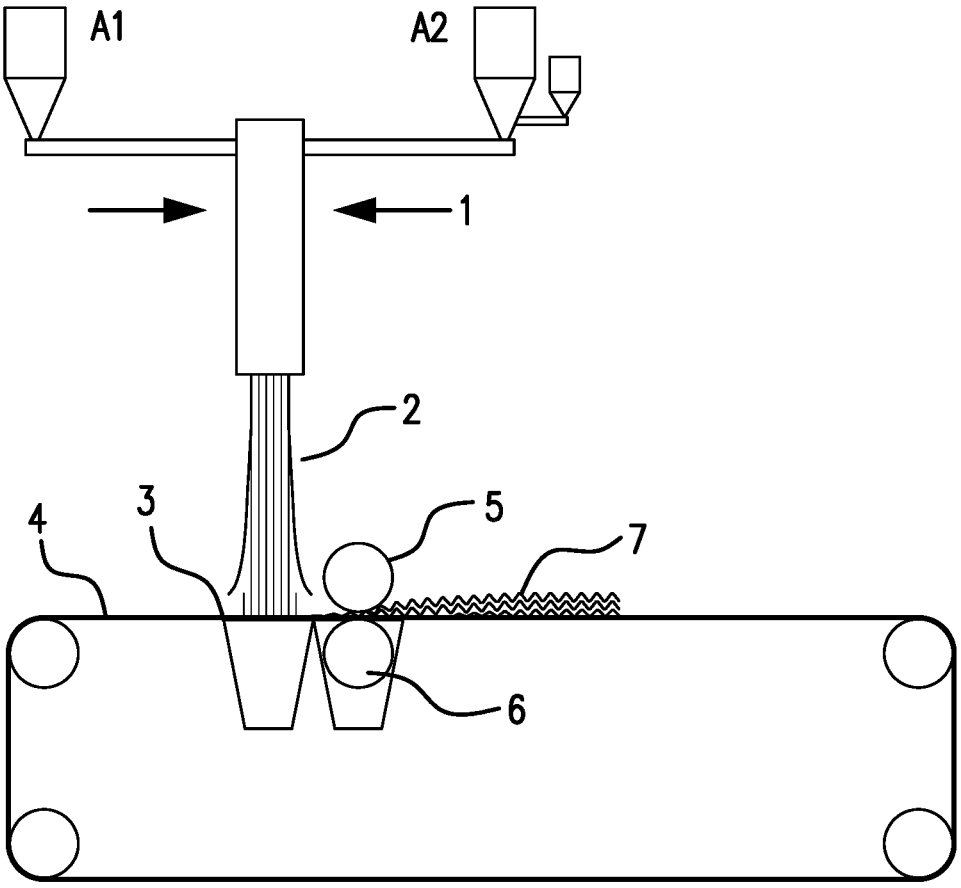

(51) Int. Cl.

| | |
|---|---|
| ***D04H 1/50*** | (2012.01) |
| ***D04H 3/147*** | (2012.01) |
| *D01D 5/22* | (2006.01) |
| *D01F 8/06* | (2006.01) |
| *D04H 3/007* | (2012.01) |
| *D04H 3/16* | (2006.01) |

(52) U.S. Cl.

CPC ..... *D01D 5/22* (2013.01); *D01F 8/06* (2013.01); *D04H 3/007* (2013.01); *D04H 3/16* (2013.01)

(56) References Cited

U.S. PATENT DOCUMENTS

| | | | | |
|---|---|---|---|---|
| 6,037,281 | A | 3/2000 | Mathis et al. | |
| 6,454,989 | B1 * | 9/2002 | Neely | D04H 3/007 264/555 |
| 2002/0019206 | A1 | 2/2002 | Deka et al. | |
| 2004/0067709 | A1 | 4/2004 | Kishine et al. | |
| 2004/0097154 | A1 * | 5/2004 | Bansal | D04H 3/14 442/345 |
| 2005/0130545 | A1 | 6/2005 | Bansal et al. | |
| 2006/0246242 | A1 | 11/2006 | Siegel et al. | |
| 2008/0220161 | A1 | 9/2008 | Sommer et al. | |
| 2009/0100565 | A1 | 4/2009 | Grynaeus et al. | |
| 2018/0002850 | A1 | 1/2018 | Hansen et al. | |

FOREIGN PATENT DOCUMENTS

| | | | | | |
|---|---|---|---|---|---|
| JP | 2013133579 | A | * | 7/2013 | D04H 3/007 |
| JP | 2013133579 | A | | 7/2013 | |
| WO | 0028123 | A1 | | 5/2000 | |
| WO | 2004059058 | A1 | | 7/2004 | |

OTHER PUBLICATIONS

Bhat et al, "Development of structure and properties during spunbonding of propylene polymers," Thermochimica Acta 392-392, 2002, pp. 323-328.

Caldas et al, "The structure of the mesomorphic phase of quenched isotactic polypropylene," Polymer, vol. 35, No. 5, 1994, pp. 899-907.

Extended European Search Report issued in corresponding European Patent Application No. 16170169.3 dated Dec. 7, 2016 (8 pages).

Brown et al, "The structure of the mesomorphic phase of quenched isotactic polypropylene" Polymer Papers, vol. 35, No. 5, 1994, pp. 899-907.

Third party observation issued in corresponding Japanese Patent Application No. 2020-106952 (English translation only) (16 pages).

* cited by examiner

METHOD FOR MAKING A SPUNBONDED HIGH LOFT NONWOVEN WEB

This application is a divisional of U.S. patent application Ser. No. 15/597,171, filed May 17, 2017, which claims priority to EP 16 170 169.3 EP, filed May 18, 2016.

The invention relates to a method for making a spunbonded high loft nonwoven web comprising crimped multicomponent fibers. The invention further relates to nonwoven webs obtained by such method.

High loft spunbonded layers may contribute to the provision of nonwoven fabrics having a high softness as desired in hygiene products such as diapers, sanitary napkins and the like. Nonwoven fabrics comprising spunbonded high loft layers on the basis of crimped fibers are known in the art.

One high loft spunbonded fabric is described in U.S. Pat. No. 6,454,989 B1. The crimp of the fibers is thereby achieved upon using multicomponent fibers where the two components have different melt flow rates. Another high loft spunbonded fabric is described in EP 2 343 406 B1. The crimp of the fibers is thereby achieved upon using multicomponent fibers where the two components have similar melt flow rates and melting points, but a certain difference in the ratio of Z-average to weight average molecular weight distributions. Yet another spunbonded high loft fabric is described in EP 1 369 518 B1. The crimp of the fibers is thereby achieved upon using multicomponent fibers where one component is a homopolymer and another component is a co-polymer.

Neither of the nonwovens from the prior art has been fully satisfactory in terms of loft, softness and tensile properties. The purpose of the invention is to provide a method to obtain high loft spunbonded fabrics that are more satisfactory in terms of these properties.

Against this background the invention pertains to a method for making a spunbonded high loft nonwoven web comprising crimped multicomponent fibers, the process comprising continuously spinning the fibers, directing the fibers to a spin-belt by deflectors and/or air streams, laying down the fibers on the spinbelt and pre-consolidating the fibers after laydown using one or more pre-consolidation rollers to form a pre-consolidated web, wherein a first component of the fibers comprises a PP homopolymer and a second component of the fibers comprises a PP/PE copolymer, and wherein the pre-consolidation rollers are operated at a temperature of smaller 110° C. and/or a linear contact force of smaller 5 N/mm.

Both the PP homopolymer and the PP/PE copolymer are thermoplastic. In one embodiment, the PP homopolymer and the PP/PE copolymer, respectively, are the only polymers comprised in the first and second component, respectively. The first and second component, respectively, may consist of the PP homopolymer and the PP/PE copolymer, respectively, and, optionally, non-polymer additives.

In one embodiment, the PP homopolymer and/or the PP component of the PP/PE copolymer may comprise a mixture of more than one PP based polymers.

The fibers are preferably helically crimped and/or endless fibers.

The fabric produced by the method of the invention as a very soft touch like a microfleece fabric, and at the same time, it has high tensile properties. It is believed that the addition of a PE/PP copolymer avoids an undesired dry or cottony feel.

In one embodiment, the pre-consolidation rollers are operated at a temperature of 50-100° C., preferably 60-80° C. and/or at a linear contact force of 1-4 N/mm, preferably 2-3 N/mm. A linear contact force of 1-2.5 N/mm can also be preferred. A temperature of 20-<110° C., 40-90° C. or 55-75° C. can also be preferred.

In one embodiment, the content of ethylene-stemming repetitive units in the PP/PE copolymer is 1-10 wt %, preferably 2-6 wt % and more preferably 3-5 wt %. A content of >0-5 wt % can also be preferred.

In one embodiment, the PP/PE copolymer is a random copolymer.

In one embodiment, the PP homopolymer is isotactic.

In one embodiment, the melt flow rates and/or the polydispersities of the PP homopolymer and the PP/PE copolymer differ by less than 30%, less than 25% or less than 20%. In terms of absolute values, the MFR (melt flow rate) of the PP homopolymer and/or the PP/PE copolymer may be in the range of 20-40 or 25-35, for example about 25, 30 or 35 g/10 min.

In one embodiment, the melting points (TM) of the PP homopolymer and the PP/PE copolymer differ by 5° C. or 10° C. or more and/or differ by 20° C. or less. The TM difference can be in the range of 5-20° C. In terms of absolute values, for example, the PP homopolymer may exhibit a melting point in the range of 155-165° C. or 159-163° C. and the PP/PE copolymer may exhibit a melting point in the range of 140-148° C. or 142-146° C. The melting points may be determined using DSC.

In one embodiment, the fibers have a denier of 1.2-3.0.

In one embodiment, the multicomponent fibers are bicomponent fibers.

In one embodiment, the multicomponent fibers have a side-by-side configuration. In alternative embodiments, the multicomponent fibers may have (eccentric) sheath-core or trilobal configurations.

In one embodiment, the weight ratio of the first to second component in the multicomponent fibers is 40/60-80/20, preferably 40/60-60/40.

In one embodiment, the method further comprises bonding the pre-consolidated web using one or more calandering rolls, at least one of which is embossed. In one embodiment, the bond pattern introduced by the calandering rolls comprises a bond area of 10-16% and/or a dot density of 20-45 dots/cm$^2$ and/or a dot size of 0.35-0.55 mm$^2$ per dot to leave enough room for as many crimped fibers to pop out of the structure as possible. In one embodiment, the calandering rolls are operated at a temperature of 120-145° C.

In one embodiment, the method further comprises bonding the pre-consolidated web using hot air through bonding. In one embodiment, the air used in hot air through bonding has a temperature of 120-145° C.

In one embodiment, the method uses a hybrid process where the pre-consolidated fabric is additionally activated or bonded in a post bond process by at least two bonding techniques consisting of the methods of thermal roll bonding, IR bonding and air through bonding in conjunction.

In one embodiment, the method of the invention forms part of an overall process to form a layered nonwoven fabric such as, e.g., a spunmelt nonwoven fabric of an SMS, $S_HS_SS_H$, $S_SS_H$ or other type.

The overall process may include more inventive methods of forming high loft spunbonded layers, where each layer is pre-consolidated using pre-consolidation rollers operated at a described temperature and/or linear contact force. In one embodiment of such overall process, bonding may only occur after all layers have been laid down and pre-consolidated.

In one embodiment, the overall process comprises at least one meltblown layer (M) and/or at least one standard loft spunbond layer ($S_S$), where these additional layers form a nonwoven laminate with the at least one high loft layer spunbond layer ($S_H$) produced by the method of the invention, preferably an SMS-type, $S_HS_SS_H$-type or $S_SS_H$-type nonwoven laminate.

The term 'standard nonwoven' is used herein simply to name the respective other spunbond nonwoven layer, which will have a lower degree of loft due to traditional non-crimped and usually monocomponent fibers. Also this term, however, is merely qualitative and does not imply a certain maximum degree of loft. The invention provides, however, that the density of the high loft spunbond layer is lower than the density of the standard nonwoven layer.

In one embodiment, additional meltblown layer(s) can be formed on one or both surfaces of the $S_H$ layer. As the crimped fibers of the $S_H$ layers may entangle with a substrate, e.g. the spinbelt in fabric production, applying a meltblown cover may improve release properties.

In one embodiment, the fabric comprises at least one melt blown layer (M) sandwiched between at least one standard loft spunbond layer ($S_S$) and the at least one high loft spunbond layer ($S_H$). Possible such SMS-type laminates comprise $S_SMS_H$, $S_SMMS_H$, $S_SS_SMS_H$, $S_SMS_HS_H$, $S_SS_SMMS_H$, $S_SMMS_HS_H$, $S_SS_SMMS_HS_H$ etc. laminates.

The standard loft spunbond layers ($S_S$) may contribute to an improved mechanical stability of the laminate, e.g., to an improved stability against rupturing and puncturing. The meltblown layers (M) may contribute to an improved barrier property which is desirable, e.g., for so-called barrier leg-cuffs of hygiene products.

In this embodiment, the invention envisions to combine good barrier properties with a soft and bulky textile character of the nonwovens by means of combining 'traditional' spunbond nonwovens with spunbond nonwovens comprising crimped fibers according to the invention.

Of course, in an alternative embodiment, in each of the above SMS-laminates, another $S_H$ may be used instead of the (or each) $S_S$ layer ($S_HMS_H$ and so forth). The other $S_H$ layer may be the same or different from the first $S_H$ layer formed with a process according to the invention. It may, for example, also be formed with a method according to the invention but upon using other fiber configurations (one $S_H$ layer side-by-side, the other sheath-core) or may be formed from any known method of obtaining high-loft $S_H$ layers. This is particularly interesting for products were a high level of masking is desired.

In one embodiment, where the method of the invention forms part of an overall process to form a layered nonwoven fabric, the layered fabric may comprise at least one standard loft spunbonded layer and at least one high loft spunbonded layer formed in agreement with the invention. Resulting fabrics may be of the general type $S_HS_SS_H$ (including variants such as $S_HS_SS_SS_H$, $S_HS_SS_HS_H$, $S_HS_SS_SS_HS_H$ and so forth). In this, embodiment, a sandwich structure comprising a first high loft spunbonded layer ($S_H$) and a center layer based on standard spunbond ($S_S$) followed by another high loft spunbonded layer ($S_H$) layer is obtained. This would lead to a structure where, as compared to a spunmelt $S_HMS_H$ structure, the meltblown (M) center layer is replaced with an $S_S$ layer. Adding a layer of essentially uncrimped standard spunbond nonwoven $S_S$ sandwiched in between two or more layers of high loft spunbonded fabric ($S_H$) leads to an increase in strength and stability to the material. At the same time both, outer layers of the embodiments exhibit desirably high softness from the high loft spunbonded fabric ($S_H$).

In yet another embodiment, resulting fabrics may be of the general type $S_HS_S$ (including variants such as $S_SS_H$, $S_SS_HS_H$, $S_SS_SS_HS_H$ and so forth). In this embodiment, a layer structure comprising a first standard loft spunbonded base layer ($S_S$) and high loft spunbonded top layer ($S_H$) layer is obtained. Again, adding layer(s) of essentially uncrimped standard spunbond nonwoven $S_S$ to layer(s) of high loft spunbonded fabric ($S_H$) leads to an increase in strength and stability to the material, while the top layer exhibits desirably high softness.

Against the initially described background, the invention further pertains to a nonwoven fabric obtained by the method of the invention. The fabric may have a specific strength of greater 20 $N \cdot cm^3 \cdot g^{-2}$ and/or a density of less than $6 \cdot 10^{-2}$ $g \cdot cm^3$.

Figure 2:
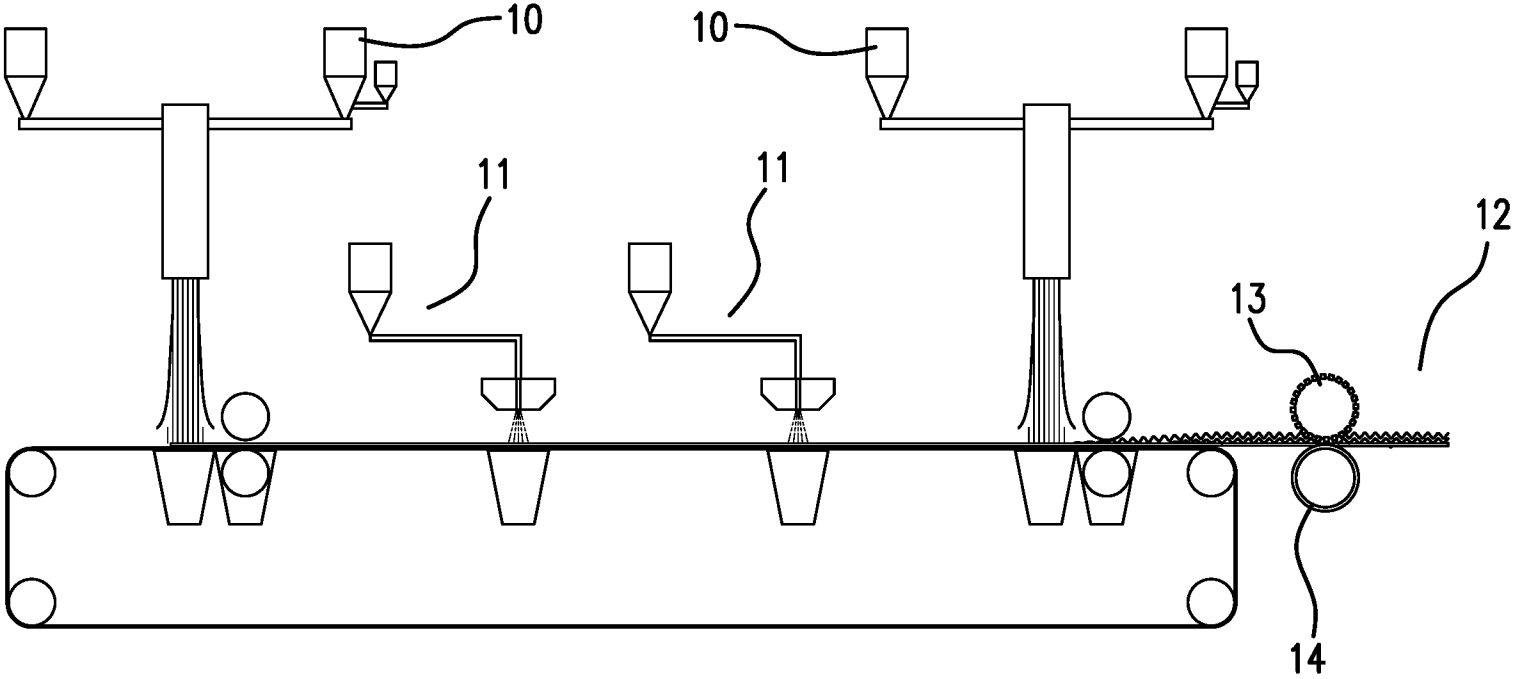
Figure 3:
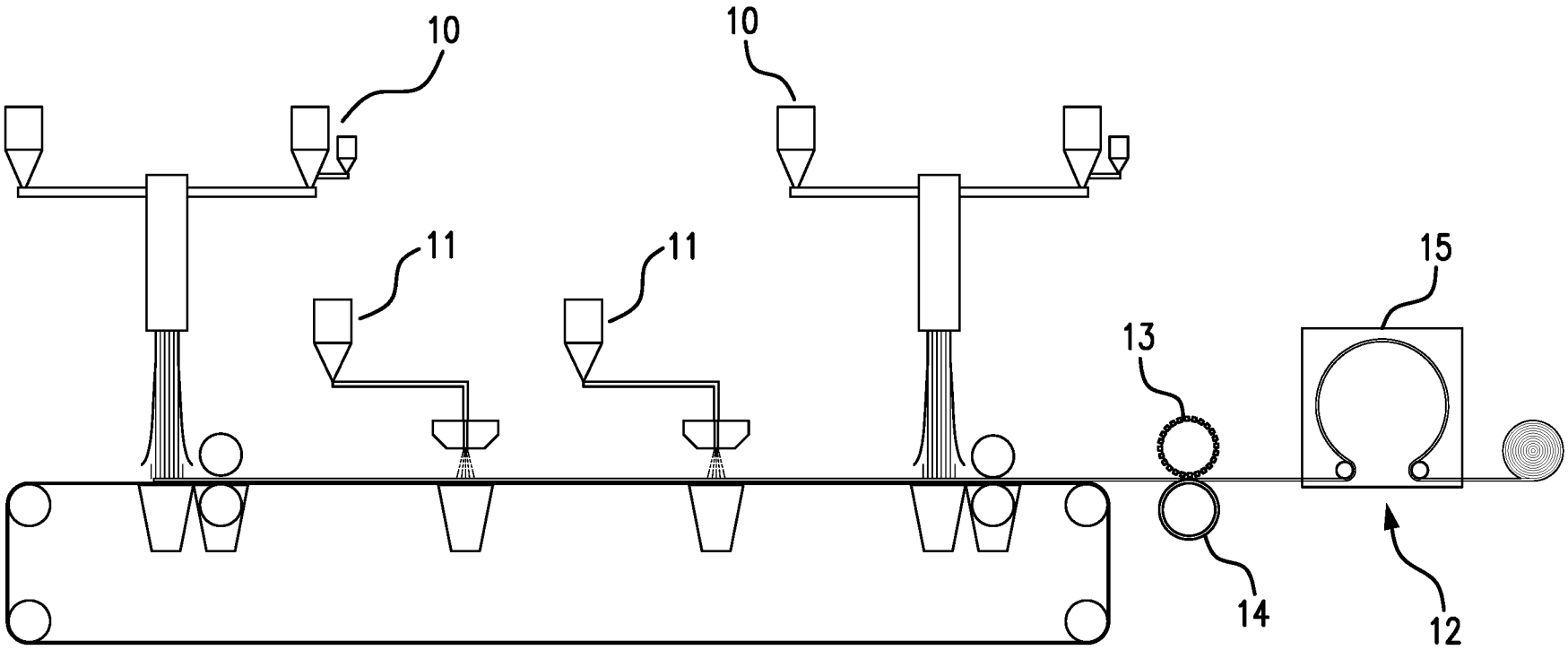
Figure 4:
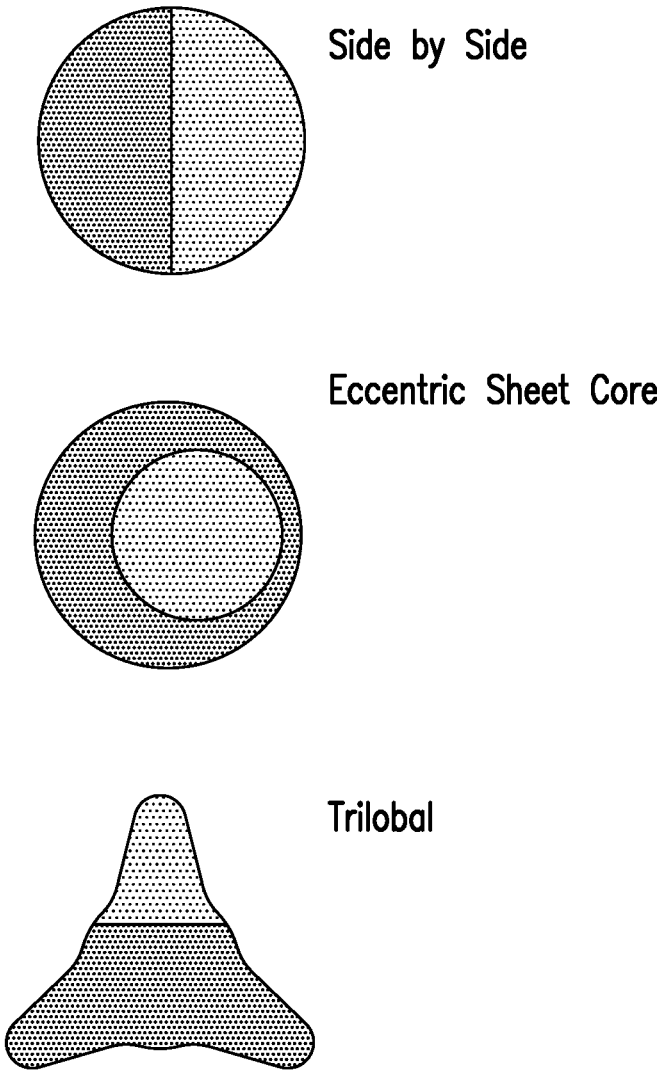

Further details and advantages of the present invention are described with reference to the figures and following working examples. The figures show:

FIG. 1: a process line for carrying out a method of the invention (single beam);

FIG. 2: another process line for carrying out a method of the invention (2 spunbond beams and 2 meltblown beams);

FIG. 3: the process line of FIG. 2 complemented with an Omega oven for hot air through bonding; and FIG. 4: sketches of side-by-side, eccentric sheath core and trilobal bicomponent fiber configurations.

The following terms and abbreviations may be used in the working examples.

MFR: Melt Flow Rate as measured according to ISO 1133 with values shown in g/10 min and conditions being 230° C. and 2.16 Kg MD: Machine Direction CD: Cross machine Direction Denier: g/9000 m filament Change to thickness of a material was measured according to WSP.120.1 (R4), Option A.

Crimp: typically helically crimped fibers

Neck-in: a materials tendency to shrink widthwise when exposed to a certain tensile/force in MD Density: $g/cm^3$ weight unit per volume unit GSM: gram per square meter TM: melting point in ° C. as determined according to DSC (Differential Scanning calorimetry) method ISO 11357-3

GPC: Gel Permeation Chromatography

Specific strength: To obtain the specific strength in the units of N×cm3/g2, the area weight was assumed in grams The values for molecular weight averages ($M_z$, $M_w$ and $M_n$), molecular weight distribution (MWD) and its broadness, described by polydispersity index, PDI=$M_w/M_n$ (wherein $M_n$ is the number average molecular weight and $M_w$ is the weight average molecular weight) as used herein are to be understood as having been determined by GPC according to ISO 16014-1:2003, ISO 16014-2:2003, ISO 16014-4:2003 and ASTM D 6474-12 using the following formulae:

$$M_n = \frac{\sum_{i=1}^{N} A_i}{\sum_{i=1}^{N} (A_i / M_i)} \tag{1}$$

$$M_w = \frac{\sum_{i=1}^{N} (A_i \times M_i)}{\sum_{i=1}^{N} A_i} \tag{2}$$

$$M_z = \frac{\sum_{i=1}^{N} (A_i \times M_i^2)}{\sum_{i=1}^{N} (A_i \times M_i)} \tag{3}$$

For a constant elution volume interval $\Delta V_i$, where $A_i$, and $M_i$ are the chromatographic peak slice area and polyolefin molecular weight (MW), respectively associated with the elution volume, $V_i$, where N is equal to the number of data points obtained from the chromatogram between the integration limits.

A high temperature GPC instrument, equipped with either infrared (IR) detector (IR4 or IR5 from PolymerChar (Valencia, Spain) or differential refractometer (RI) from Agilent Technologies, equipped with 3× Agilent-PLgel Olexis and 1× Agilent-PLgel Olexis Guard columns was used. As the solvent and mobile phase 1,2,4-trichlorobenzene (TCB) stabilized with 250 mg/L 2,6-Di tert butyl-4-methyl-phenol) was used. The chromatographic system was operated at 160° C. and at a constant flow rate of 1 mL/min. 200 μL of sample solution was injected per analysis. Data collection was performed using either Agilent Cirrus software version 3.3 or PolymerChar GPC-IR control software.

The column set was calibrated using universal calibration (according to ISO 16014-2:2003) with 19 narrow MWD polystyrene (PS) standards in the range of 0.5 kg/mol to 11 500 kg/mol. The PS standards were dissolved at room temperature over several hours. The conversion of the polystyrene peak molecular weight to polyolefin molecular weights is accomplished by using the Mark Houwink equation and the following Mark Houwink constants:

$$K_{PS}=19\times10^{-3}\ \text{mL/g},\ a_{PS}=0.655$$

$$K_{PE}=39\times10^{-3}\ \text{mL/g},\ a_{PE}=0.725$$

$$K_{PP}=19\times10^{-3}\ \text{mL/g},\ a_{PP}=0.725$$

A third order polynomial fit was used to fit the calibration data.

All samples were prepared in the concentration range of 0.5-1 mg/ml and dissolved at 160° C. for 2.5 hours.

FIG. 1 illustrates a process line for carrying out a method of the invention, more specifically a bicomponent spunbond method. The process line is equipped with two independent extruders A1 and A2, which process different polymers. The polymers are guided to a coathanger in separate channels. Under the coathanger a die consisting of several guide plates is mounted, which enables to obtain various cross fiber segments.

A typical configuration of bicomponent fibers is a sheath-core configuration. Other configurations can be where the two polymer streams are arranged in a side-by-side arrangement, eccentric sheath-core arrangement, trilobal etc. as illustrated in FIG. 4.

Where extruder A1 is processing a homopolymer and extruder A2 is processing a random copolymer and the die is configured as a side-by-side configuration, helically crimped fibers are generated under certain spinning conditions.

After exiting the die the filaments are cooled in unit 1 by means of conditioned process air. The same process air is used to draw the filaments in the stretching unit 2 on drawing to obtain the right fibers denier and thereby to generate internal strength in the fibers by arranging polymer chains in the same direction.

After laydown of the fibers on the spunbelt 4, the process air is sucked away by vacuum chamber 3. The fibers are then exposed to a nip for pre-consolidation by means of a set of rollers, one compaction roller 5 and one counter roller 6 below the spinbelt.

The resultant and pre-consolidated web 7 is after it exits the pre-consolidation process deposited on the spinbelt free of any forces, and with a light fiber to fiber integration enough to withstand further processing.

It has been found that when processing two polymers where one first polymer being a regular PP homopolymer in combination with one second random PP/PE copolymer in a side-by-side arrangement the fibers are able to generate helical crimp.

The resultant fabric 7 features a very soft touch comparable to the touch of the well-known microfleece. As the crimped fibers of this polymer combination offer very uniform and consistent crimp levels, the resultant fabric of such fibers will display high tensile properties.

In one example, the first polymer a homopolymer used in A1 is a traditional spunbond grade with an narrow molecule distribution $M_w/M_n$ (polydispersity) in the range of 4.33-4.93 measured with GPC as described in terms and conditions, and a MFR measured according to ISO 1133 range of 19-35 g/10 min and a $T_M$ of 159-161° C. measured with DSC according to ISO 11357-3. As the second polymer, a random copolymer with a $M_w/M_n$ (polydispersity) value of 4.54 and hence a similar narrow molecule distribution as the polymer of A1 is used. The MFR of the polymer in A2 measured according to ISO 1133 is in the range of 30 g/10 min and the TM at 144° C. as measured with DSC according to ISO 11357-3. The second polymer is a PP/PE random copolymer containing a C2 level of approx. 4% and has been nucleated to a certain degree.

The parameter settings at the consolidations rollers 5 and 6 have an important impact on the fabric quality. In prior art processes, consolidation rollers are typically operated at pressures and temperatures in the range of 5 N/mm linear contact forces and a temperature of 110-130° C. When processing crimped fibers as described above at such conditions, however, crimp is ironed out and the fabrics exhibit poor thickness and softness. According to the invention, the rollers 5 and 6 are hence operated at temperatures and linear contact forces lower than in the prior art.

In FIGS. 2 and 3, complex lines for obtaining spunmelt nonwovens comprising a spunbond line as described in FIG. 1 are shown. Besides the line 10 as described in FIG. 1, the apparatuses further comprise meltblown lines 11 and a bonding apparatus 12 comprising an embossed calander roll 13 and a counter roll 14 as well as, in the case of FIG. 3, an Omega-oven 15 for hot air through bonding.

All examples described below use a line as described in FIG. 1.

In the examples discussed in the following, the polymers as indicated in Table 1 were used.

TABLE 1

| Type | | MFR g/10 min | TM (DSC) C. | Mn g/mol | Mw g/mol | Mz g/mol | Mw/Mn | Mw/Mz |
|---|---|---|---|---|---|---|---|---|
| A1 Moplen HP561R | Propylene Homopolymer | 25 | 161 | 34300 | 160500 | 333500 | 4.68 | 2.08 |

TABLE 1-continued

| Type | | MFR g/10 min | TM (DSC) C. | Mn g/mol | Mw g/mol | Mz g/mol | Mw/Mn | Mw/Mz |
|---|---|---|---|---|---|---|---|---|
| Borealis HF420FB | Propylene Homopolymer | 19 | 161 | 45150 | 195500 | 431000 | 4.33 | 2.20 |
| Exxon 3155 | Propylene Homopolymer | 35 | 159 | 30150 | 148500 | 307500 | 4.93 | 2.07 |
| A2 Moplen RP248R | Propylene Co-polymer | 30 | 144 | 33600 | 152500 | 308000 | 4.54 | 2.02 |

In the comparative examples discussed in the following, the polymers as indicated in Table 2 were used.

TABLE 2

| Type | | MFR g/10 min | TM (GPC) C. | Mn g/mol | Mw g/mol | Mz g/mol | Mw/Mn | Mw/Mz |
|---|---|---|---|---|---|---|---|---|
| A1 Moplen HP561R | Propylene Homopolymer | 25 | 161 | 34300 | 160500 | 333500 | 4.68 | 2.08 |
| A2 Moplen RP552R | Propylene Homopolymer | 25 | 163 | 25900 | 176500 | 514000 | 6.81 | 2.91 |
| Moplen HP561R | Propylene Homopolymer | 25 | 161 | 34300 | 160500 | 333500 | 4.68 | 2.08 |

EXAMPLES 1-5

General process conditions for the spunbond process in examples 1-5 are as follows.

Approx. 4900 capillary holes/m

Side by side die configuration

Cabin pressure of 3700 Pa

Process air temperature of approx. 20° C.

Melt temperature of A1 and A2 between 245 and 250° C.

Throughput per capillary hole in the range of 0.53 g/hole/min

Titer range of 1.5-2.0 denier

Consolidation roller: 2.5 N/mm linear contact force and temperature of 70° C.

Calandering rollers 135° C. on the point bond emboss roll and 125° C. on the smooth roll linear contact force 60 N/mm Bond pattern 12.1% open dot bond pattern with a dot diameter of 0.8 mm and 24 dot/cm$^2$ depth of engraving 0.75 mm Results are shown in Table 3.

In the above it is seen the outcome of tests of parameters of the resultant fabric with varying polymer combinations of A1/A2 in the MFR range of 35/30 g/10 min, 25/30 g/10 min and 19/30 g/10 min. As seen all combinations generate crimp in the sense that a caliper of 0.33 mm to 0.44 mm is measured. MD Tensile properties are positively high and elongation properties remain on an acceptable low level.

EXAMPLES 6-10

General process conditions for the spunbond process in examples 6-10 are as follows.

Approx. 4900 capillary holes/m

Side by side die configuration

Cabin pressure of 3700 Pa

Process air temp approx. 20° C.

Melt temperature of A1 and A2 between 245 and 250° C.

Throughput per capillary hole in the range of 0.53 g/hole/min

Titer range of 1.5-2.0 denier

Consolidation roller: 2.5 N/mm linear contact force and temperature of 40° C.

Calandering rollers 135° C. on the point bond emboss roll and 125° C. on the smooth roll linear contact force 60 N/mm Bond pattern 12.1% open dot bond pattern with a dot diameter of 0.8 mm and 24 dot/cm$^2$ depth of engraving 0.75 mm

TABLE 3

| Example | A1 polymer | A2 polymer | Ratio A1/A2 | Bw gsm | Caliper mm | Density g/cm3 | TSMD N/50 mm | TEMD % | TSCD N/50 mm | TECD % |
|---|---|---|---|---|---|---|---|---|---|---|
| 10 | Exxon 3155 | RP248R | 50/50 | 20.6 | 0.37 | 0.0557 | 29.2 | 74.9 | 17.5 | 78.0 |
| 2 | Exxon 3155 | RP248R | 70/30 | 21.2 | 0.33 | 0.0642 | 33.2 | 56.2 | 17.8 | 62.4 |
| 3 | HP561R | RP248R | 50/50 | 20.7 | 0.42 | 0.0493 | 27.8 | 104.0 | 17.0 | 119.0 |
| 4 | HP561R | RP248R | 70/30 | 20.6 | 0.35 | 0.0589 | 36.7 | 96.8 | 25.4 | 116.8 |
| 5 | HF420FB | RP248R | 50/50 | 20.0 | 0.44 | 0.0455 | 26.9 | 135 | 17.8 | 137.0 |

Results are shown in Table 4.

TABLE 4

| Example | A1 polymer | A2 polymer | Ratio A1/A2 | Bw gsm | Caliper mm | Density g/cm3 | TSMD N/50 mm | TEMD % | TSCD N/50 mm | TECD % |
|---|---|---|---|---|---|---|---|---|---|---|
| 6 | HP561R | RP248R | 40/60 | 21.5 | 0.60 | 0.0358 | 21.4 | 121 | 12.7 | 129 |
| 7 | HP561R | RP248R | 50/50 | 21.9 | 0.49 | 0.0447 | 32.3 | 137 | 17.5 | 129 |
| 8 | HP561R | RP248R | 60/40 | 20.9 | 0.36 | 0.0581 | 35.4 | 112 | 21.4 | 131 |
| 9 | HP561R | RP248R | 70/30 | 20.1 | 0.34 | 0.0591 | 45.3 | 112 | 26.0 | 125 |
| 10 | HP561R | RP248R | 80/20 | 20.0 | 0.34 | 0.0588 | 48.3 | 100 | 26.7 | 103 |

In the above example list is seen the outcome when varying the polymer ratios between A1 and A2 but keeping all other parameters constant, consolidation rollers are in all options operated with a contact force of 2.5 N/mm and with a temperature of approx. 40° C.

It is noticed that a maximum crimp level is seen in the option with a 40/60 ratio where a caliper of 0.6 mm is measured, but also as noticed a relatively low tensile property in the range of 21.4 N/50 mm in MD and 12.7 N/50 m in CD is obtained with this ratio.

EXAMPLES 11-17

General process conditions for the spunbond process in examples 11-17 are as follows.

Approx. 4900 capillary holes/m

Side by side die configuration

Cabin pressure of 3700 Pa

Process air temp approx. 20° C.

Melt temperature of A1 and A2 between 245 and 250° C.

Throughput per capillary hole in the range of 0.53 g/hole/min

Titer range of 1.5-2.0 denier

Consolidation roller: 2.5 N/mm linear contact force and temperature range from 50° C. to 110° C.

Calandering rollers 135° C. on the point bond emboss roll and 125° C. on the smooth roll linear contact force 60 N/mm Bond pattern 12.1% open dot bond pattern with a dot diameter of 0.8 mm and 24 dot/cm$^2$ depth of engraving 0.75 mm Results are shown in Table 5.

In the above examples 11-17 all process parameters are kept the same except from the temperature on the consolidation roller. The roller are in all options operated with a contact force of 2.5 N/mm and the temperature are set to an increasing level from 50° C. to 110° C. in steps of approx. 10° C.

EXAMPLES 18-23

General process conditions for the spunbond process in examples 18-23 are as follows.

Approx. 4900 capillary holes/m

Side by side die configuration

Cabin pressure of 3700 Pa

Process air temp approx. 20° C.

Melt temperature of A1 and A2 between 245 and 250° C.

Throughput per capillary hole in the range of 0.53 g/hole/min

Titer range of 1.5-2.0 denier

Consolidation roller: 2.5 N/mm linear contact force and a temperature of 40° C.

Calandering rollers 135° C. on the point bond emboss roll and 125° C. on the smooth roll linear contact force 60 N/mm Bond pattern 12.1% open dot bond pattern with a dot diameter of 0.8 mm and 24 dot/cm$^2$ depth of engraving 0.75 mm

TABLE 5

| Example | A1 polymer | A2 polymer | Ratio A1/A2 | CR C | Bw gsm | Caliper mm | Density g/cm3 | TSMD N/50 mm | TEMD % | TSCD N/50 mm | TECD % |
|---|---|---|---|---|---|---|---|---|---|---|---|
| 11 | HF420FB | RP248R | 50/50 | 50 | 20.0 | 0.476 | 0.0420 | 25.7 | 130 | 18.1 | 154 |
| 12 | HF420FB | RP248R | 50/50 | 60 | 19.7 | 0.476 | 0.0414 | 27.0 | 136 | 17.1 | 138 |
| 13 | HF420FB | RP248R | 50/50 | 71 | 20.0 | 0.470 | 0.0426 | 28.0 | 139 | 17.3 | 149 |
| 14 | HF420FB | RP248R | 50/50 | 82 | 20.2 | 0.448 | 0.0451 | 27.3 | 130 | 17.4 | 156 |
| 15 | HF420FB | RP248R | 50/50 | 91 | 19.8 | 0.432 | 0.0458 | 26.5 | 132 | 18.8 | 165 |
| 16 | HF420FB | RP248R | 50/50 | 97 | 20.0 | 0.370 | 0.0541 | 27.6 | 135 | 17.7 | 152 |
| 17 | HF420FB | RP248R | 50/50 | 110 | 19.8 | 0.358 | 0.0553 | 26.0 | 126 | 17.1 | 151 |

Results are shown in Table 6.

TABLE 6

| Example | A1 polymer | A2 polymer | Ratio A1/A2 | Oven C | Bw gsm | Caliper mm | Density g/cm3 | TSMD N/50 mm | TEMD % | TSCD N/50 mm | TECD % |
|---|---|---|---|---|---|---|---|---|---|---|---|
| 18 | HF420FB | RP248R | 50/50 | 120 | 19.0 | 0.39 | 0.0487 | 28.8 | 113.6 | 16.8 | 132.2 |
| 19 | HF420FB | RP248R | 50/50 | 125 | 19.3 | 0.42 | 0.0460 | 30.2 | 109.9 | 17.1 | 129.7 |
| 20 | HF420FB | RP248R | 50/50 | 130 | 20.0 | 0.41 | 0.0488 | 29.5 | 99.6 | 15.9 | 122.0 |
| 21 | HF420FB | RP248R | 50/50 | 135 | 20.9 | 0.38 | 0.0550 | 31.5 | 99.3 | 15.7 | 121.8 |
| 22 | HF420FB | RP248R | 50/50 | 140 | 19.5 | 0.38 | 0.0513 | 30.1 | 97.1 | 14.9 | 137.1 |
| 23 | HF420FB | RP248R | 50/50 | 145 | 20.0 | 0.40 | 0.0500 | 29.2 | 71.4 | 12.8 | 130.0 |

In the above examples all process parameters are kept constant and the crimped consolidated and calander bonded web has been post activated in an oven with an air through bonding process where the airflow through the consolidated web is kept constant and the temperature of the air in the oven is varied from 120° C. to 145° C.

General observations processing options listed from 1-23: Various combinations of polymer ratios have been processed without any negative observations. Process conditions were very stable and smooth to run including transitions from option to option. Spinning wise, the fiber curtain was steady at all conditions and no fiber breakage leading to droplets or drips were observed.

COMPARATIVE EXAMPLES 24-26

General process conditions for the spunbond process in comparative examples 24-26 are as follows.

Approx. 4900 capillary holes/m

Side by side die configuration

Cabin pressure of 4000 Pa

Process air temp approx. 18° C.

Melt temperature of A1 and A2 between 245 and 248° C.

Throughput per capillary hole in the range of 0.58 g/hole/min

Titer range of 1.5-2.0 denier

Consolidation roller: 2.5 N/mm linear contact force and varying temperature from 41-88° C.

Calandering rollers 160° C. on the point bond emboss roll and 145° C. on the smooth roll linear contact force 60 N/mm Bond pattern 12.1% open dot bond pattern with a dot diameter of 0.8 mm and 24 dot/cm$^2$ depth of engraving 0.75 mm Results are shown in Table 7.

TABLE 7

| Example | A1 polymer | A2 polymer | Ratio A1/A2 | CR C | Bw gsm | Caliper mm | Density g/cm3 | TSMD N/50 mm | TEMD % | TSCD N/50 mm | TECD % |
|---|---|---|---|---|---|---|---|---|---|---|---|
| 24 | HP561R | HP552R/ HP561R | 70/30 (50/50) | 41 | 20.4 | 0.66 | 0.0309 | 18.1 | 91.3 | 9.4 | 123.9 |
| 25 | HP561R | HP552R/ HP561R | 70/30 (50/50) | 62 | 20.6 | 0.67 | 0.0307 | 15.1 | 107.1 | 10.4 | 132.7 |
| 26 | HP561R | HP552R/ HP561R | 70/30 (50/50) | 88 | 20.5 | 0.65 | 0.0315 | 15.8 | 109.5 | 9.5 | 126.9 |

In the above is shown obtained data from reference options from known PP/PP based crimped consolidated fabric of the style aggressive crimp. The polymer ratios are 70/30 between A1 and A2, and the A2 extruder is feed with a polymer blend of 50% HP561R and 50% HP552R (narrow and broad distributed). All process parameters are kept constant except from the temperature of the consolidation roller. The consolidation roller is kept with a constant linear contact force of 2.5 N/50 mm but the temperature are varied from 41° C. to 88° C. Calander temperature is 160° C. on the embossing roller and 145° C. on the smooth roller.

EXAMPLES 27-31 AND COMPARATIVE EXAMPLE 32

These examples serve to demonstrate the excellent specific strength of nonwoven materials produced according to the invention. The examples are summarized in Table 8.

TABLE 8

| Example | A1 polymer | A2 polymer | Ratio A1/A2 | Bw gsm | Caliper mm | Density g/cm3 | TSMD N/50 mm | Specific strength N × cm3/g2 |
|---|---|---|---|---|---|---|---|---|
| 27 | HP561R | RP248R | 40/60 | 21.5 | 0.60 | 0.0358 | 21.4 | 27.9 |
| 28 | HP561R | RP248R | 50/50 | 21.9 | 0.49 | 0.0447 | 32.3 | 33.3 |

TABLE 8-continued

| Example | A1 polymer | A2 polymer | Ratio A1/A2 | Bw gsm | Caliper mm | Density g/cm3 | TSMD N/50 mm | Specific strength N × cm3/g2 |
|---|---|---|---|---|---|---|---|---|
| 29 | HP561R | RP248R | 60/40 | 20.9 | 0.36 | 0.0581 | 35.4 | 29.2 |
| 30 | HP561R | RP248R | 70/30 | 20.1 | 0.34 | 0.0591 | 45.3 | 38.0 |
| 31 | HP561R | RP248R | 80/20 | 20.0 | 0.34 | 0.0588 | 48.3 | 41.2 |
| 32 | HF420FB | NA | 100 | 19.3 | 0.31 | 0.0623 | 50.4 | 42.1 |

Comparative Example 32 is a reference monocomponent material, which was run with significant higher calander bonding temperatures with 162° C. (calander oil temperature) for the embossing roller and 145° C. (calander oil temperature) for the smooth roller. All other examples were run at 135° C. (calander oil temperature) for the embossing roller and 125° C. (calander oil temperature) for the smooth roller. All other process settings are identical.

Of the above is seen that the maximum obtainable MD tensile is 50.4 N/50 mm which is measured for the option with no crimp (Comparative Example 32), this results in a specific strength of 42.1 $N \cdot cm^3/g^2$. It is seen that for the lower density options with different polymer ratios and lower density due to crimped fibers the absolute tensile is reduced which leads to a reduced specific strength. The optimum between crimp/softness/thickness and specific strength found with a polymer ratio of the homopolymer and the copolymer of 50/50 which results in a specific strength of 33.3 $N \cdot cm^3/g^2$.

Specific strength compensates for the materials individual density and basis weight.

COMPARATIVE EXAMPLES 33-35

These examples constitute high loft reference options for specific strength. The examples are summarized in Table 9.

TABLE 9

| Example | A1 polymer | A2 polymer | Ratio A1/A2 | CR C | Bw gsm | Caliper mm | Density g/cm3 | TSMD N/50 mm | Specific strength N × cm3/g2 |
|---|---|---|---|---|---|---|---|---|---|
| 33 | HP561R | HP552R | 70/30 | 90 | 21.1 | 0.43 | 0.0500 | 21.1 | 22.7 |
| 34 | Exxon 3155 | HP552R | 70/30 | 90 | 20.6 | 0.42 | 0.0490 | 21.4 | 21.3 |
| 35 | HP561R | HP552R/ HP561R | 70/30 (50/50) | 88 | 20.5 | 0.65 | 0.0315 | 15.8 | 24.5 |

The following Table 10 compares specific strength parameters obtained for examples 27-35 mentioned above. Comparative Example 32 is considered to be optimum of what is feasible under the given process conditions, and this specific strength is set to 100% the ranges for other high loft options can be calculated as follows.

TABLE 10

| Example | A1 polymer | A2 polymer | Ratio A1/A2 | Specific strength Nxcm3/g2 | Rating |
|---|---|---|---|---|---|
| 32 | HF420FB | NA | 100 | 42.1 | 100 |
| 27 | HP561R | RP248R | 40/60 | 27.9 | 66.2 |
| 28 | HP561R | RP248R | 50/50 | 33.3 | 79.1 |
| 29 | HP561R | RP248R | 60/40 | 29.2 | 69.4 |
| 30 | HP561R | RP248R | 70/30 | 38.0 | 90.2 |
| 31 | HP561R | RP248R | 80/20 | 41.2 | 97.9 |
| 33 | HP561R | HP552R | 70/30 | 22.7 | 53.7 |
| 34 | Exxon 3155 | HP552R | 70/30 | 21.3 | 50.5 |
| 35 | HP561R | HP552R/ HP561R | 70/30 (50/50) | 24.5 | 58.2 |

It has been found that materials of this invention have a high specific strength. As shown in Example 28 with a 50/50 ratio of the two different polymers, this appears to be the best rating on the scale when at the same time a low density/high caliper is prioritized. Obviously, when the ratio of the two polymers are changed from a 50/50 blend towards a more monocomponent blend that generates less crimp, the specific tensile increased and actually the option with a 80/20 blend are very close to a regular monocomponent material in terms specific strength.

Comparing basic PP/PP crimped nonwovens made with two homopolymers with a difference in molecule distribution (one being narrow and the other being more broad), it is seen these options perform relative poor on the scale for specific strength. All options both with medium as well as aggressive crimp are between 50.5 and 58.2 on the scale where 100 is max value for a monocomponent material. Materials of this invention are for comparison close to 80% on the scale.

The invention claimed is:

1. A spunbonded nonwoven fabric comprising crimped multicomponent fibers comprising a first component that comprises PP homopolymer and a second component that comprises a PP/PE copolymer, and obtained by a method comprising continuously spinning multicomponent fibers, directing the multicomponent fibers to a spin-belt by deflectors, air streams, or both, laying down the multicomponent fibers on the spin-belt, and pre-consolidating the multicomponent fibers after laydown utilizing one or more pre-consolidation rollers to form a pre-consolidated web, wherein the pre-consolidation rollers are operated at a temperature of 91° C. or below and a linear contact force of below 5 N/mm, and wherein the spunbonded nonwoven fabric has a specific strength of greater than 20 $N \cdot cm^3 \cdot g^{-2}$ and a density of less than $6 \cdot 10^{-2}$ $g \cdot cm^{-3}$.

2. The spunbonded nonwoven fabric of claim 1, wherein the pre-consolidation rollers are operated at a temperature of from 20° C. to 91° C.

3. The spunbonded nonwoven fabric of claim 1, wherein the pre-consolidation rollers are operated at a linear contact force of 1-4 N/mm.

4. The spunbonded nonwoven fabric of claim 1, wherein the content of ethylene-stemming repetitive units in the PP/PE copolymer is >0-5 wt %.

5. The spunbonded nonwoven fabric of claim 1, wherein the PP/PE copolymer is a random copolymer.

6. The spunbonded nonwoven fabric of claim 1, wherein the PP homopolymer is isotactic.

7. The spunbonded nonwoven fabric of claim 1, wherein melt flow rates, or polydispersities of the PP homopolymer and the PP/PE copolymer, or both differ by less than 30%.

8. The spunbonded nonwoven fabric of claim 1, wherein melting points of the PP homopolymer and of the PP/PE copolymer differ by 10° C. or more.

9. The spunbonded nonwoven fabric of claim 1, wherein the multicomponent fibers are bicomponent fibers or have a side-by-side configuration or both.

10. The spunbonded nonwoven fabric of claim 1, wherein a weight ratio of the first component to second component is from 40/60 to 80/20.

11. The spunbonded nonwoven fabric of claim 1, wherein said method further comprising bonding the pre-consolidated web utilizing one or more calandering rolls, at least one of which is embossed, or utilizing hot air through bonding, or both.

12. The spunbonded nonwoven fabric of claim 11, wherein the calandering rolls are operated at a temperature of or the air used in hot air through bonding has a temperature of from 120° C. to 145° C.

13. The spunbonded nonwoven fabric of claim 1, wherein the pre-consolidation rollers are operated at a temperature of from 40° C. to 90° C.

14. The spunbonded nonwoven fabric of claim 1, wherein the pre-consolidation rollers are operated at a temperature of from 55° C. to 75° C.

15. The spunbonded nonwoven fabric of claim 1, wherein the pre-consolidation rollers are operated at a linear contact force of from 1 to 2.5 N/mm.

16. The spunbonded nonwoven fabric of claim 1, wherein melt flow rates, or polydispersities of the PP homopolymer and the PP/PE copolymer, or both differ by less than 20%.

17. The spunbonded nonwoven fabric of claim 1, wherein melting points of the PP homopolymer and of the PP/PE copolymer differ by 20° C. or less.

18. The spunbonded nonwoven fabric of claim 1, wherein a weight ratio of the first component to second component is from 40/60 to 60/40.

* * * * *